US006382984B1

(12) United States Patent
Yu

(10) Patent No.: US 6,382,984 B1
(45) Date of Patent: May 7, 2002

(54) ELECTRICAL CARD CONNECTOR FOR SOLDERLESSLY ELECTRICALLY CONNECTING TO A PRINTED CIRCUIT BOARD

(75) Inventor: Hung-Chi Yu, Hsi-Chih (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/752,403

(22) Filed: Dec. 27, 2000

(30) Foreign Application Priority Data

Nov. 15, 2000 (TW) ..... 89219740 U

(51) Int. Cl.[7] ..... H01R 9/09
(52) U.S. Cl. ..... 439/64; 439/79
(58) Field of Search ..... 439/65, 64, 79, 439/80, 573, 564, 135

(56) References Cited

U.S. PATENT DOCUMENTS 4,687,267 A * 8/1987 Header et al. ..... 439/64
5,176,523 A * 1/1993 Lai ..... 439/64
5,318,452 A * 6/1994 Brennian, Jr. ..... 439/79
5,653,596 A * 8/1997 Banakis et al. ..... 439/64
5,681,174 A * 10/1997 Correll, Jr. et al. ..... 439/135
6,066,003 A * 5/2000 Chang ..... 439/573
6,174,194 B1 * 1/2001 Hirata et al. ..... 439/79

* cited by examiner

*Primary Examiner*—Hien Vu
(74) *Attorney, Agent, or Firm*—Wei Te Chung

(57) ABSTRACT

An electrical card connector for electrically connecting to a printed circuit board (5) includes an insulative housing (1), a plurality of terminals (2, 3), and a fastening device (4). The housing comprises a transverse beam (10) and a pair of arms (11) formed on opposite ends of the transverse beam. A plurality of passageways (12) is defined in the transverse beam. The terminals each have a fixing portion (22, 32) engaging with the passageway, and a touch portion (23, 33) extending beyond a bottom of the transverse beam. When the electrical card connector is fastened to the printed circuit board by the fastening device, the touch portions of the terminals resiliently make electrical contact with corresponding electrical pads (54) mounted on the printed circuit board.

14 Claims, 3 Drawing Sheets

ELECTRICAL CARD CONNECTOR FOR SOLDERLESSLY ELECTRICALLY CONNECTING TO A PRINTED CIRCUIT BOARD

BACKGROUND OF THE INVENTION

1. Field of the Invention

The present invention relates to an electrical card connector, and particularly to an electrical card connector having terminals electrically connectable to a printed circuit board using solderless means.

2. Description of the Related Art

In the prior art, an electrical card connector has a plurality of terminals electrically connecting to a printed circuit board by one of two means. One means is to directly solder the terminals to the printed circuit board. Using this means, two different soldering technologies are available to achieve an electrical connection between the terminals and the printed circuit board. One soldering technology, through-hole technology, requires insertion of each terminal through a corresponding through hole defined in the printed circuit board. The terminals are then soldered to the printed circuit board. However, the difficulty with this technology is that it is not easy to align each terminal with each corresponding through hole; thus, the alignment operation is inconvenient. Another soldering technology, surface mounting technology (SMT), requires soldering of each terminal to a surface of a solder pad of the printed circuit board. However, this technology requires planarity of all the terminal ends and of all the solder pads on the printed circuit board prior to soldering, which presents its own problems. The other means of connecting the terminals to the printed circuit board is to use an adaptor. With this means, the terminals of the electrical card connector are plugged into the adaptor, which has been previously soldered to the printed circuit board. This means is costly in terms of additional components required and the electric resistance between the printed circuit board and the connector is increased. Thus, the connection process is costly and the connection is less desirable.

Hence, an improved electrical card connector is required to overcome the disadvantages of the prior art.

BRIEF SUMMARY OF THE INVENTION

A main object of the present invention is to provide an electrical card connector which can be expediently connected to a printed circuit board.

An electrical card connector for electrically connecting an electrical card to a printed circuit board comprises an insulative housing, a plurality of terminals, and a fastening device. The housing comprises a transverse beam and a pair of arms formed on opposite ends of the transverse beam. A plurality of passageways is defined in the transverse beam. The terminals each have a contacting portion at one end thereof for electrically connecting with an electrical card, a fixing portion extending opposite the contacting portion and fixed in a corresponding passageway, and a touch portion extending downwardly from the fixing portion. The touch portion comprises a first section perpendicular to the fixing and contacting portions and a second section parallel to the fixing portion. The second section protrudes in a resilient arc below a bottom face of the housing. The fastening device comprises a pair of screws and nuts. The screws are insertable through a pair of fastening holes defined in both arms of the housing. The electrical card connector is fastened on the printed circuit board by the screws extending through the fastening holes and through a pair of positioning holes defined in the printed circuit board to engage with the nuts. The second sections of the touch portions of the terminals resiliently make electrical contact with corresponding electrical pads mounted on the printed circuit board.

Other objects, advantages and novel features of the invention will become more apparent from the following detailed description of the present embodiment when taken in conjunction with the accompanying drawings.

DETAILED DESCRIPTION OF THE INVENTION

Figure 1:
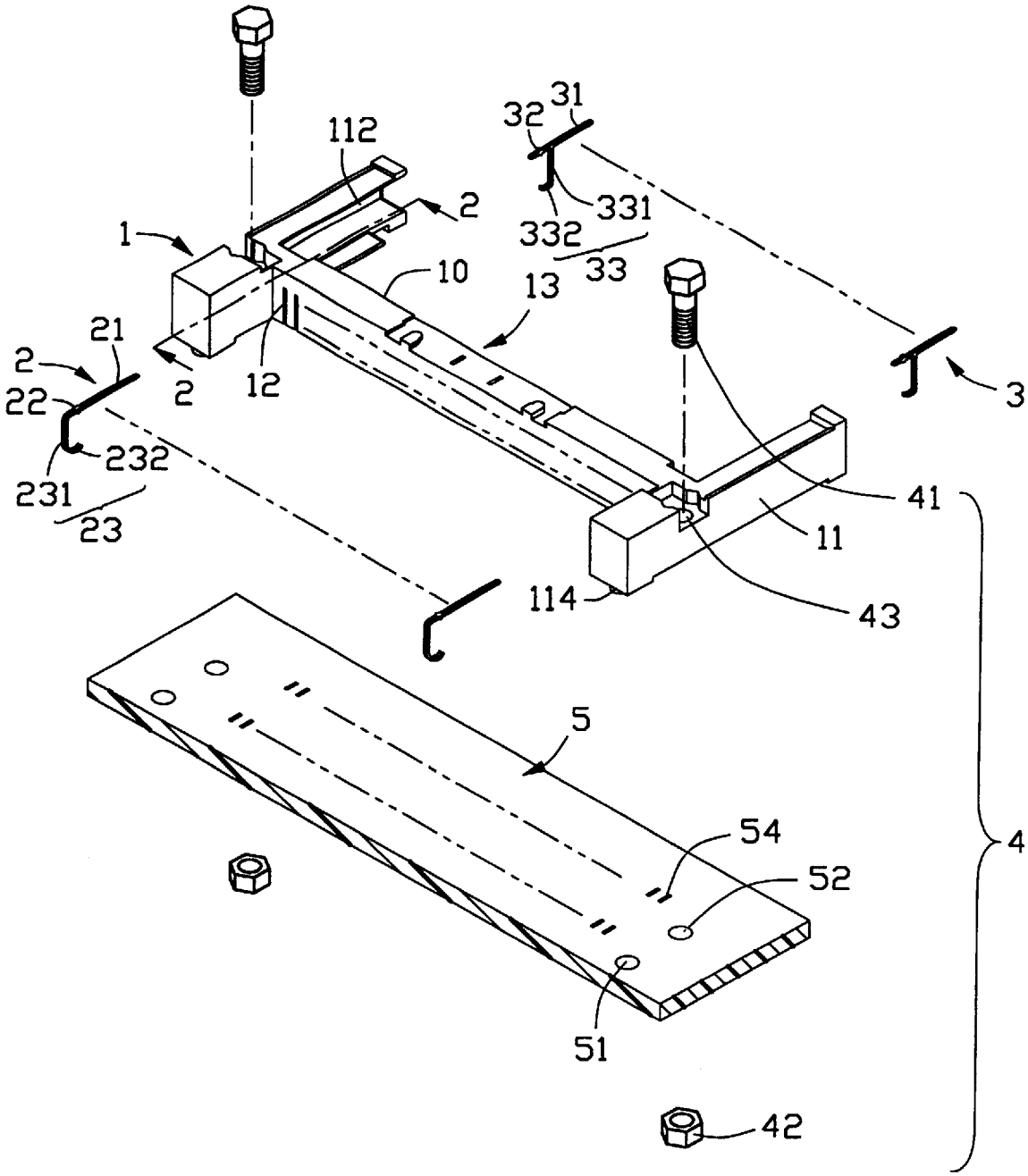
FIG. 1 is an exploded view of an electrical card connector with a printed circuit board in accordance with the present invention.

Referring to FIG. 1, an electrical card connector in accordance with the present invention for electrically connecting to a printed circuit board 5 comprises an insulative housing 1, a plurality of first terminals 2, a plurality of second terminals 3, and a fastening device 4.

Figure 2:
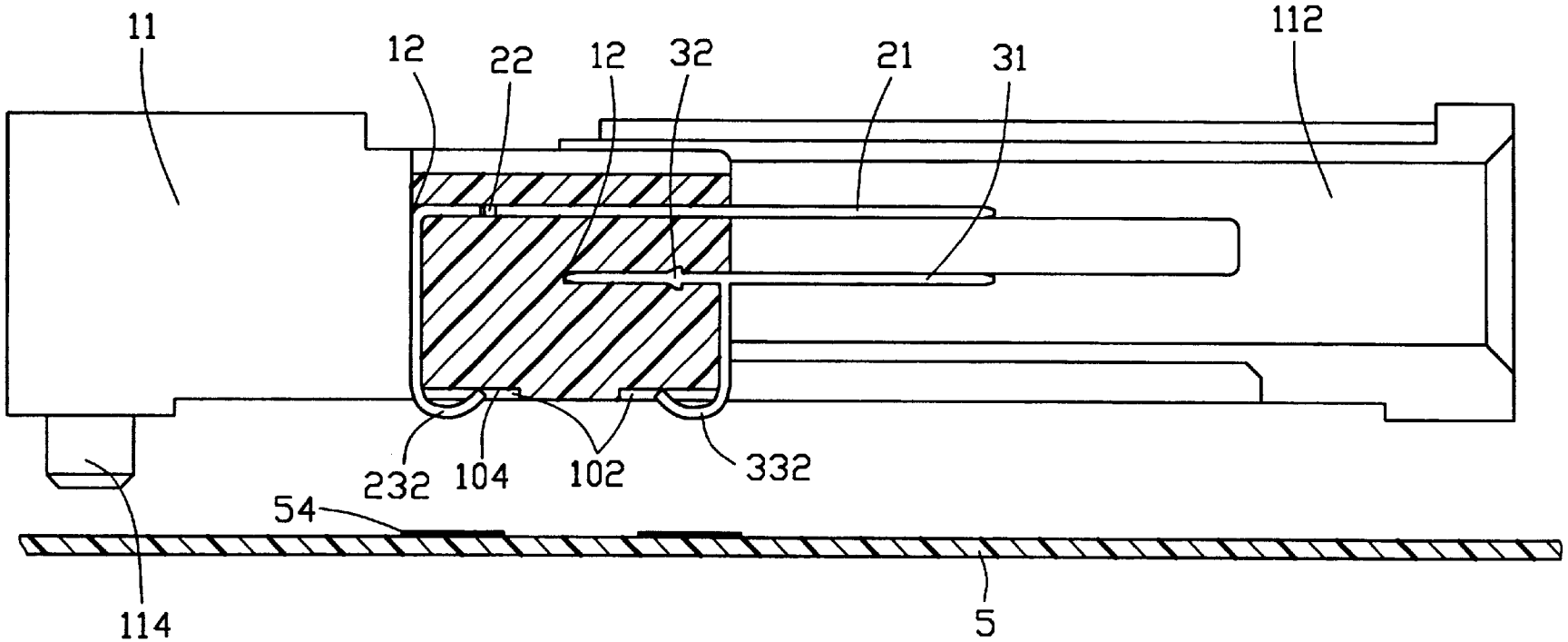
FIG. 2 is a cross sectional view of the electrical card connector of FIG. 1 taken along line 2—2 of FIG. 1, prior to mounting on the printed circuit board.

The housing 1 comprises a transverse beam 10 and a pair of arms 11 formed on opposite ends of the transverse beam 10. A receiving space 13 is defined between both arms 11 and the transverse beam 10. The beam 10 has a first face (not labeled) and a second face (not labeled) opposite the first face and facing to the receiving space 13. A plurality of passageways 12 is defined in the transverse beam 10 and each passageway 12 is partly parallel to the arms 11 and partly defined in the first or second face. Referring to FIG. 2, a plurality of recesses 102 is defined in a bottom face (not labeled) of the transverse beam 10 and each recess 102 aligns and communicates with a corresponding passageway 12. The arms 11 each define a channel 112 communicating with the receiving space 13 for guiding an electrical card (not shown) mating with the electrical card connector. A pair of projections 114 is formed on bottom faces (not labeled) of the arms 11.

Each first terminal 2 has a contacting portion 21 at one end thereof for electrically connecting with the electrical card, a fixing portion 22 at a middle thereof, connecting to the contacting portion 21, and a J-shaped touch portion 23 at a second end thereof extending downwardly from the fixing portion 22. The touch portion 23 comprises a first section 231 perpendicular to the fixing portion 22 and a second section 232 parallel to the fixing portion 22. Each second terminal 3 comprises a contacting portion 31 at one end thereof, a fixing portion 32 at a second end opposite the contacting portion 31, and a J-shaped touch portion 33 extending downwardly and perpendicularly to the contacting portion 31 and the fixing portion 32 from a junction of the contacting portion 31 and the fixing portion 32. The touch portion 33 comprises a first section 331 perpendicular to the fixing portion 32 and a second section 332 parallel to the fixing portion 32. The second sections 232, 332 each have an arced shape and are resiliently bendable.

The fastening device 4 comprises a pair of screws 41, and a pair of nuts 42. A pair of fastening holes 43 is correspondingly defined in both arms 11 adjacent to the beam 10 for extension of the screws 41 therethrough.

Referring to FIG. 2, in assembly, the first and second terminals 2, 3 are inserted into the corresponding passageways 12 with the fixing portions 22, 32 being fixed within the passageways 12, the contacting portions 21, 31 extending beyond the second face into the receiving space 13 for a predetermined first distance and a predetermined second distance, and the touch portions 23, 33 respectively partly received in the passageways defined in the first and second faces of the transverse beam 10 and partly extending into the recesses 102 to abut against recessed faces 104 of corresponding recesses 102. The predetermined first distance is equal to the predetermined second distance. By engaging with the recesses 102, the second sections 232, 332 of the touch portions 23, 33 are prevented from moving in a direction parallel to the longitudinal axis of the transverse beam. Each arc-shaped second section 232, 332 protrudes below the bottom face (not labeled) of the transverse beam 10.

Figure 3:
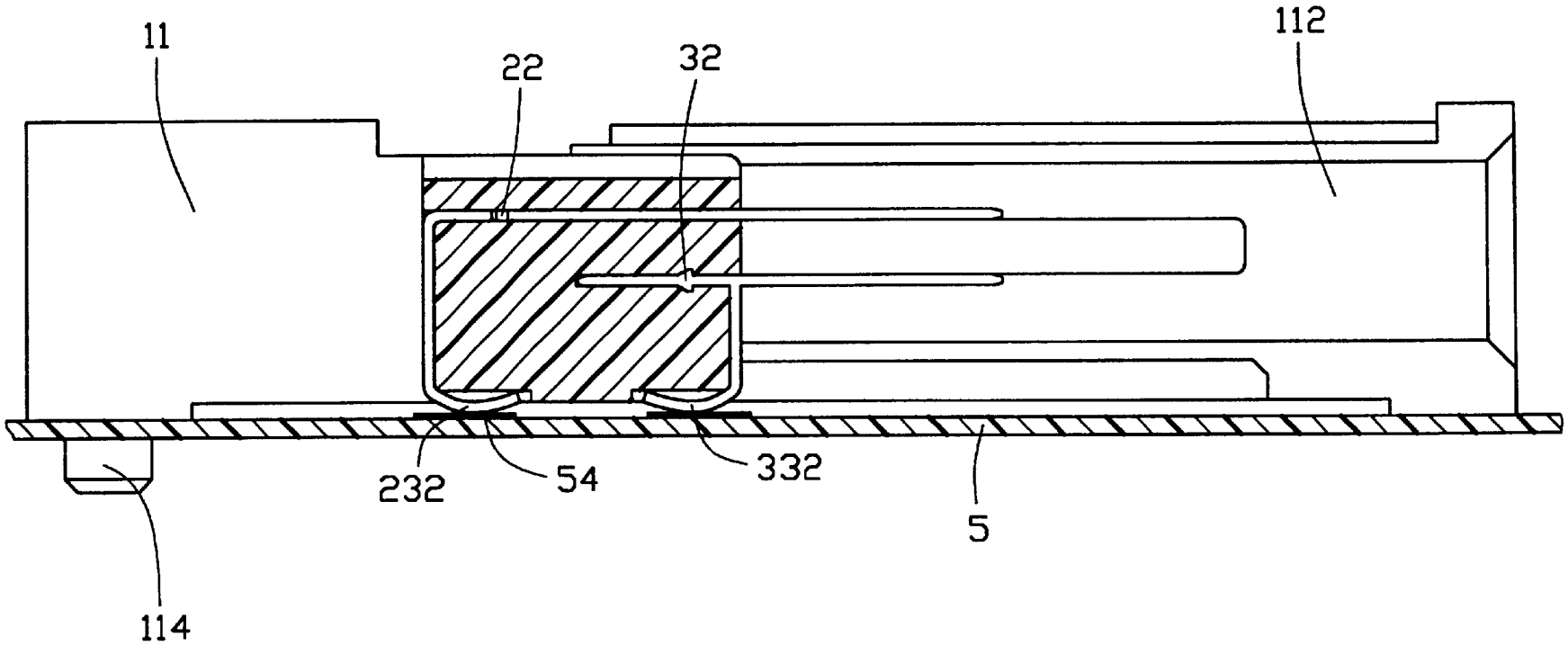
FIG. 3 is a cross sectional view of the electrical card connector mounted on the printed circuit board.

Referring to FIG. 3, the projections 114 of the housing 1 are inserted into a pair of positioning holes 51 defined in the printed circuit board 5 whereby the fastening holes 43 align with through holes 52 bored into the printed circuit board 5. The screws 41 extend through the fastening holes 43 and the through holes 52 to fasten with corresponding nuts 42, thereby fixing the electrical card connector to the printed circuit board 5. At the same time, the second sections 232, 332 of the terminals 2, 3 resiliently slide along the recessed face 104 and make electrical contact with electrical pads 54 mounted on the printed circuit board 5 with the radian of the arced shape of the second section 232, 332 decreasing to achieve electrical connection between the electrical card connector and the printed circuit board 5.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical card connector for mating with an electrical card and mounting to a printed circuit board, a plurality of electrical pads being provided on the printed circuit board, comprising:

an insulative housing comprising a transverse beam and a pair of arms formed on opposite ends of the transverse beam, a receiving space defined between the transverse beam and both arms, the transverse beam having a first face and a second face opposite the first face and facing the receiving space, a plurality of passageways defined in the transverse beam, a plurality of recesses defined in a bottom face of the transverse beam and each recess aligning and communicating with a corresponding passageway;

a plurality of terminals, each comprising a fixing portion fixed in a corresponding passageway, a contacting portion extending into the receiving space for mating with the electrical card, and a touch portion extending from the fixing portion and protruding beyond a bottom face of the transverse beam;

a fastening device for fastening the electrical card connector to the printed circuit board;

wherein, when the electrical card connector is fastened to the printed circuit board, the touch portions of the terminals partly extend into the recesses from the first and second faces to abut against recessed faces of corresponding recesses thereby preventing the touch portions from moving in a direction parallel to the longitudinal axis of the transverse beam and resiliently make electrical contact with corresponding electrical pads of the printed circuit board; wherein the touch portion of each terminal comprises a first section perpendicular to the fixing portion and received in the passageway and a second section parallel to the fixing portion and received in the recess.

2. The electrical card connector as claimed in claim 1, wherein the second sections of the touch portions of the terminals each have an arced shape and are resiliently bendable.

3. The electrical card connector as claimed in claim 2, wherein the radian of the arced shape of the second section decreases when the electrical card connector is mounted on the printed circuit board.

4. The electrical card connector as claimed in claim 1, wherein the fastening device comprises a pair of screws and a pair of nuts, and a pair of fastening holes are defined through the arms of the housing, and the screws extend through the fastening holes and through a pair of through holes defined in the printed circuit board to engage with the corresponding nuts, thereby fastening the electrical card connector to the printed circuit board.

5. The electrical card connector as claimed in claim 1, wherein a pair of channels is defined in the arms of the housing, the channels communicating with the receiving space for guiding the electrical card mating with the electrical card connector.

6. The electrical card connector as claimed in claim 1, wherein a pair of projections is formed on a bottom face of each arm for extending into a pair of positioning holes defined in the printed circuit board for positioning the electrical card connector on the printed circuit board.

7. The electrical card connector as claimed in claim 1, wherein the passageways are partly defined in the first and second faces of the transverse beam, and the first sections of the touch portions of the terminals are received in the passageways defined in the first and second faces.

8. The electrical card connector as claimed in claim 1, wherein said recess has a recessed face, the second section can slide along the recessed face when the electrical card connector mounted on the printed circuit board.

9. An electrical connector comprising:

an insulative housing defining opposite first and second faces thereon;

upper and lower rows of terminals disposed in the housing; wherein each of the terminals in the upper row attached to the first face of the housing with a fixing portion and a contact portion horizontally extending from said fixing portion toward the second face and through the housing so as to be exposed to the second face with a predetermined first distance, and with a touch portion downwardly extending from said fixed portion and along the first face; and each of the terminals in the lower row attached to the second face of the housing with a contact portion horizontally extending from the second face away from the housing with a predetermined second distance, and with a fixing portion extending from the corresponding contact portion toward the first face and embedded within the housing, and with a touch portion downwardly extending from the corresponding contact portion along the second face; wherein said touch portions of the terminals in both upper and lower rows are of J-shape.

10. The connector as claimed in claims 9, wherein the touch portion of the terminal in the upper row extends from the corresponding fixing portion.

11. The connector as claimed in claim 9, wherein the touch portion of the terminal in the lower row extends between the corresponding fixing portion and contact portion.

12. The connector as claimed in claim 9, wherein said predetermined first distance is equal to said predetermined second distance.

13. The electrical card connector as claimed in claim 9, wherein the touch portion comprises a first section perpendicular to the fixing portion downwardly along the first or the second faces and a second section parallel to the fixing portion.

14. The electrical card connector as claimed in claim 13, wherein said housing has a bottom face, a plurality of recesses are defined in the bottom face of the housing, said second sections of the touch portions of the terminals in the upper and lower rows are received in the recesses.

* * * * *